US007070420B1

(12) United States Patent
Wakefield et al.

(10) Patent No.: US 7,070,420 B1
(45) Date of Patent: Jul. 4, 2006

(54) ELECTRICAL INTERCONNECT SYSTEM UTILIZING NONCONDUCTIVE ELASTOMERIC ELEMENTS AND CONTINUOUS CONDUCTIVE ELEMENTS

(76) Inventors: Steven B. Wakefield, 10 Upham St., West Newton, MA (US) 02465; Wayne S. Alden, III, 66 Dewey Ave., Whitman, MA (US) 02382; Jeffrey W. Mason, 60 John Rezza Dr., North Attleboro, MA (US) 02760; Shiraz Sameja, 835 Read St., South Attleboro, MA (US) 02703; Peter D. Wapenski, 24 Stanley Mowry Rd., Foster, RI (US) 02825

( * ) Notice: Subject to any disclaimer, the term of this patent is extended or adjusted under 35 U.S.C. 154(b) by 0 days.

(21) Appl. No.: 11/199,024

(22) Filed: Aug. 8, 2005

(51) Int. Cl.
*H01R 12/00* (2006.01)

(52) U.S. Cl. ..... 439/66

(58) Field of Classification Search ..... 439/66, 439/591, 592, 67, 85
See application file for complete search history.

(56) References Cited

U.S. PATENT DOCUMENTS 4,548,451 A * 10/1985 Benarr et al. ..... 439/85
5,101,553 A 4/1992 Carey
5,427,535 A * 6/1995 Sinclair ..... 439/66
5,599,193 A * 2/1997 Crotzer ..... 439/66
5,938,451 A * 8/1999 Rathburn ..... 439/66
5,984,691 A * 11/1999 Brodsky et al. ..... 439/66
6,056,557 A 5/2000 Crotzer et al.
6,106,305 A * 8/2000 Kozel et al. ..... 439/66
6,176,707 B1 * 1/2001 Neidich et al. ..... 439/66
6,241,533 B1 * 6/2001 Matsumoto ..... 439/67
6,271,482 B1 8/2001 Crotzer et al.
6,358,064 B1 3/2002 Szalay et al.
6,939,143 B1 * 9/2005 Rathburn ..... 439/66

* cited by examiner

*Primary Examiner*—Chandrika Prasad
*Assistant Examiner*—Harshad C Patel

(57) ABSTRACT

An electrical interconnect system is provided including a substrate and an array of electrical contacts held in the substrate. Each of the electrical contacts includes a nonconductive elastomeric element and an associated conductive element. The nonconductive element has opposite ends that are disposed beyond respective opposite sides of the substrate. The conductive element includes a body having opposite ends that are disposed exteriorly of the respective opposite ends of the nonconductive elastomeric element. The opposite ends of the nonconductive elastomeric element resiliently press against the respective opposite ends of the conductive element when a force is applied to the electrical contact.

20 Claims, 6 Drawing Sheets

ELECTRICAL INTERCONNECT SYSTEM UTILIZING NONCONDUCTIVE ELASTOMERIC ELEMENTS AND CONTINUOUS CONDUCTIVE ELEMENTS

TECHNICAL FIELD

The present disclosure relates to an electrical interconnect system, and more particularly to an electrical interconnect system utilizing nonconductive elastomeric elements and conductive elements.

BACKGROUND

Interconnect devices are used to provide electrical connection between two or more opposing arrays of contact areas for establishing at least one electrical circuit, where the respective arrays may be provided on a device, printed circuit board, Pin Grid Array (PGA), Land Grid Array (LGA), Ball Grid Array (BGA), etc. Interconnection techniques may include soldering, socketing, wire bonding, wire button contacts and plug-in connectors. In one interconnect technique using a Z-axis interconnect device, an array of Z-axis interconnect elements supported on a substrate provide electrical connection between stacked electrical components. The Z-axis interconnect device is capable of accommodating size constraints, such as related to the reduced physical size of many electrical devices. Additionally, the Z-axis interconnect devices may be non-permanently installed for accommodating the need to remove or replace components of an established electrical circuit(s).

Electrical conductivity may be provided by a Z-axis interconnect device having metal conductive contacts, each contact providing electrical connection between corresponding electrical contacts of the opposing arrays. Establishing reliable contact between the metal contacts and the metal contact areas of either of the opposing arrays may be unreliable due to height variations between electrical contacts of the opposing arrays, variations in thickness of a substrate supporting either of the opposing arrays of the conductive elements of the interconnect device, warping of a substrate of the either of the opposing arrays, etc.

In prior art electrical interconnect devices using conductive elastomeric conductive elements, such as disclosed in U.S. Pat. No. 6,056,557 and U.S. Pat. No. 6,790,057, an electrical interconnect device is provided with elastomeric conductive elements disposed in respective holes of the substrate, where the holes are arranged in a grid array. The elastomeric conductive elements are compressed between the opposing arrays, and due to the viscoelastic property of the conductive elements, the respective elastomeric conductive elements apply a mechanical force to electrical contacts of the opposing arrays for establishing reliable contact. However, the conductivity of the elastomeric elements is generated by the conductive particles contacting adjacent conductive particles under compression, resulting in a full conductive path. Additionally, the conductive elastomeric elements function optimally when in an isostress condition, which is not ideal for most interconnect applications.

SUMMARY

In accordance with one aspect of the present disclosure there is provided an electrical interconnect system including a substrate and an array of electrical contacts held in the substrate. Each of the electrical contacts includes a nonconductive elastomeric element and an associated conductive element. The nonconductive element has opposite ends that are disposed beyond respective opposite sides of the substrate. The conductive element includes a body having opposite ends that are disposed exteriorly of the respective opposite ends of the nonconductive elastomeric element. The opposite ends of the nonconductive elastomeric element resiliently press against the respective opposite ends of the conductive element when a force is applied to the electrical contact.

Pursuant to another aspect of the present disclosure, there is provided electrical interconnect system, the conductive element including a substrate and an array of electrical contacts held in the substrate. Each electrical contact includes a columnar elastomeric nonconductive element having opposite ends that are disposed beyond respective opposite sides of the substrate; and an associated conductive element. The conductive element includes a body having opposite ends, said ends having respective exterior surfaces; and an electrical path defined from the exterior surface of one end of the opposite ends of the body to the exterior surface of the other end of the opposite ends of the body. The opposite ends of the nonconductive elastomeric element resiliently press against the respective opposite ends of the conductive element when a force is applied to the electrical contact.

Pursuant to yet another aspect of the present disclosure a method is provided for forming an electrical interconnect system. The method includes the steps of providing a substrate, providing an array of electrical contacts for being held in the substrate, and providing for each of the electrical contacts a nonconductive elastomeric element having opposite ends that are disposed beyond respective opposite sides of the substrate, and an associated conductive element having opposite ends that are disposed exteriorly of the respective opposite ends of the nonconductive elastomeric element. The method further comprises the step of applying a force to the electrical contact, wherein when the force is applied the opposite ends of the nonconductive elastomeric element resiliently press against the respective opposite ends of the conductive element.

BRIEF DESCRIPTION OF THE DRAWINGS

Various embodiments of the disclosure will be described herein below with reference to the figures wherein.

DETAILED DESCRIPTION OF THE PREFERRED EMBODIMENTS

An electrical interconnect system utilizing a hybrid of nonconductive elements and electrically conductive (e.g., metal) contacts is disclosed. The electrical interconnect system provides an electrical connection between first and second devices, each device including at least one electrical contact, such as arranged as an array of contacts, where the array of contacts of the first and second devices are provided on first and second opposing boards, respectively, e.g., a printed circuit board or grid. The electrical interconnect system is sandwiched between the first and second opposing boards. For example, the first and second boards may be stacked, and the electrical interconnect system may be sandwiched therebetween. The respective electrical contacts of the first board correspond to respective electrical contacts of the second board. Upon assembly of the electrical interconnect system with the first and second boards, the electrical interconnect system establishes an electrical path, e.g., a path which provides electrical conductivity therethrough, between corresponding electrical contacts of the respective first and second boards, and provides insulation between the established electrical paths.

Figure 1:
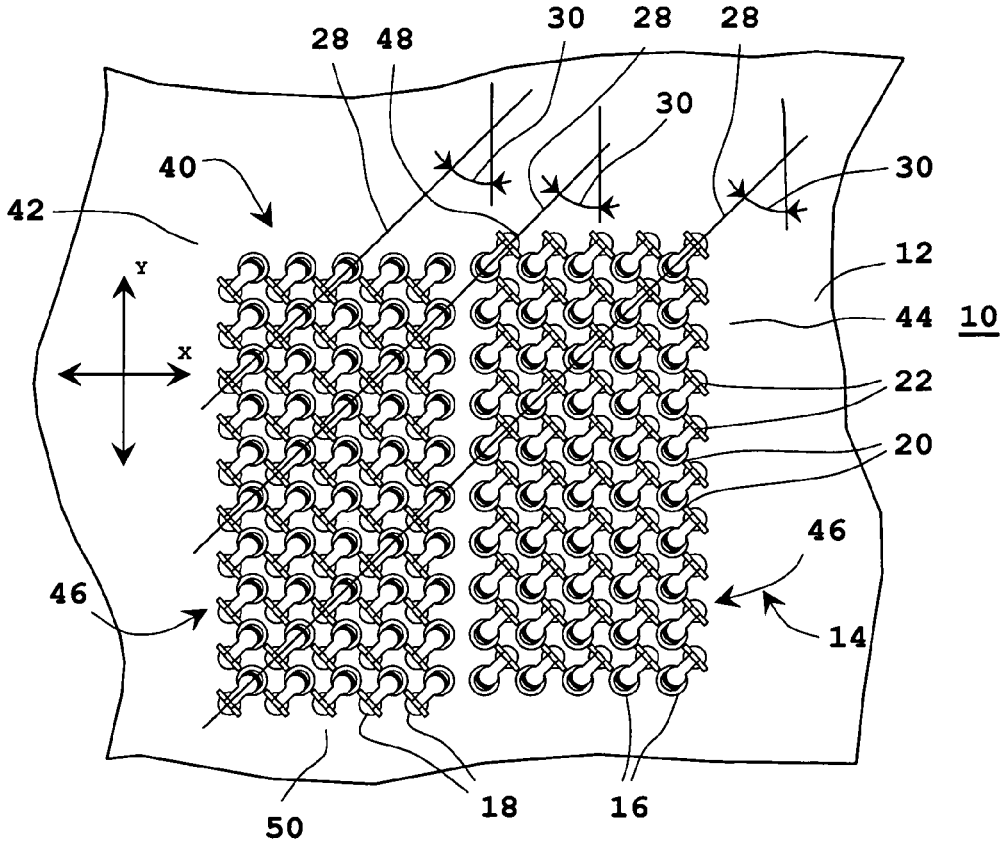
FIG. 1 is a top view of an electrical interconnect system in accordance with the present disclosure.
Figure 2:
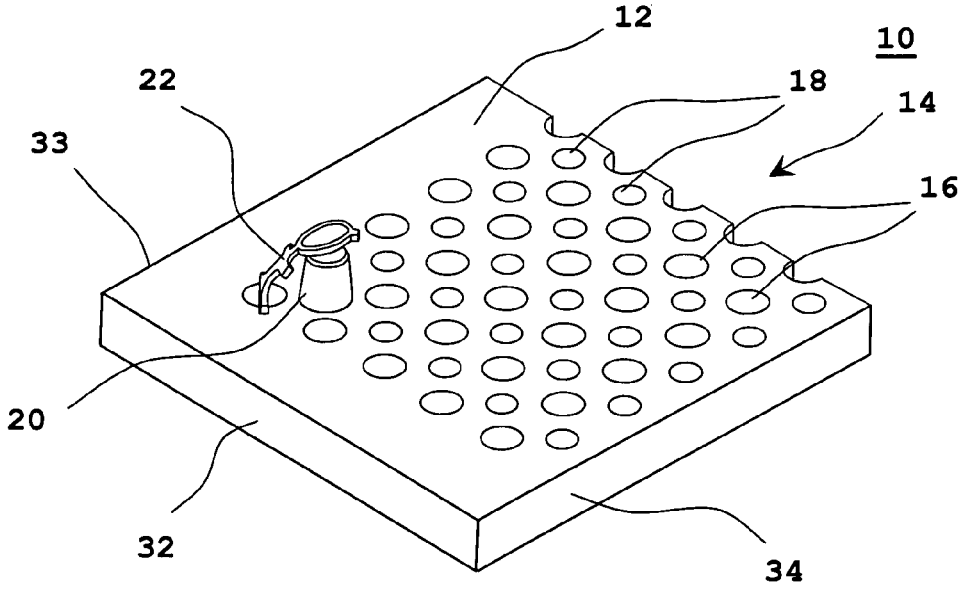
FIG. 2 is a perspective view of the substrate, a nonconductive element and an associated conductive element of the electrical interconnect system shown in FIG. 1.

Reference should be made to the drawings where like reference numerals refer to similar elements throughout the various figures. With reference to FIGS. 1 and 2, an electrical interconnect system 10 is shown having a nonconductive substrate 12 in which an array of openings 14, such as holes or slits, is provided. The array of openings 14 includes a plurality of first openings 16 and a plurality of second openings 18. Each of the first and second openings 16, 18 extends between opposing surfaces of the substrate. An array of electrical contacts 40 are provided, which are held in the substrate. The respective electrical contacts 40 are held in openings of the array of openings 14. Each of the electrical contacts 40 includes a nonconductive elastomeric element 20, and an associated conductive element 22.

FIG. 1 shows a plurality of elements 20 and conductive elements 22 retained in the array of openings 14, with each conductive element 22 positioned adjacent to its associated nonconductive element 20. FIG. 2 shows the substrate 12 and the array of openings 14, with one nonconductive element 20 and its associated conductive element 22 retained in respective openings of the array of openings 14.

Each conductive element 22 is bendable, such as at one or more joints and/or by being formed of a flexible material. When the electrical interconnect system 10 is assembled with first and second boards of respective electrical contact arrays having at least one electrical contact (not shown) the respective conductive elements 22 are bent and abut their respective associated nonconductive elements 20 for forming an interconnect element 40.

The substrate 12 is formed of an insulative material, such as a polyimide sheet (e.g., Kapton™). The material forming the substrate 12 preferably is deformable and has a memory property for returning to or nearly to its original shape prior to the deformation. An object, such as a conductive element 22, that is tightly fit (e.g., pressed) into an opening of the array of openings 14 is retained within the opening at least partly due to the memory property of the material of the substrate 12. The first openings 16 and second openings 18 are sized and shaped to retain the nonconductive elements 20 and the conductive elements 22, as appropriate. The widths of the first and second openings 16, 18 may be the same, or may be different.

In the embodiment shown in FIG. 1, the respective nonconductive elements 20 are each held, e.g., retained, in different openings 16, and the respective conductive elements 22 are each held, e.g., retained, in different openings 18. Each respective nonconductive element 20 retained in an opening 16 is paired with a unique conductive element 22 that is retained in an opening 18 adjacent to the opening 16. In another embodiment of the disclosure, a respective conductive element 22 may share an opening with a nonconductive element 20, where the conductive element 22 is paired for forming an electrical contact 40 with the nonconductive element 20 with which it shares an opening, or with a nonconductive element 20 that is located in an adjacent opening.

In accordance with the embodiment shown in FIG. 1, openings 16 and 18 are arranged in respective columns parallel to an axis designated "y", and arranged in respective rows parallel to an axis designated "x". Imaginary axes or lines 28 are shown along which the nonconductive element 20 and conductive element 22 of the electrical contacts 40 are aligned. The axes 28 are offset from a line which is parallel to the y-axis, by an angle 30 that is less than 90 degrees.

In the example shown, the nonconductive elements 20 are spaced evenly from one another along both the x and y axes, the spacing between nonconductive elements 20 along the x-axis is equal to the spacing between nonconductive elements 20 along the y-axis, and the angle 30 is forty five degrees. The spacing shown is appropriate for providing electrical connection between first and second arrays of electrical contacts of opposing boards, in which the electrical contacts of the arrays of the opposing boards are evenly spaced at equal distances along the x-axis and the y-axis, or the edges 32 and 34 of the substrate 12. In a different exemplary application (not shown), the spacing between the nonconductive elements 20 along the x-axis may differ from the spacing of the nonconductive elements 20 along the y-axis, and the angle 30 is more or less than 45 degrees.

Figure 4:
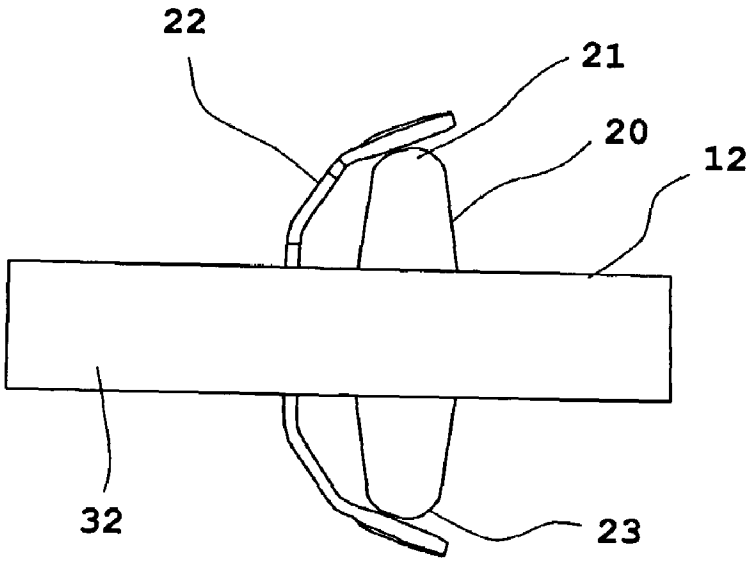
FIG. 4 is a side view of the substrate, nonconductive element and associated conductive element shown in FIG. 2.
Figure 3:
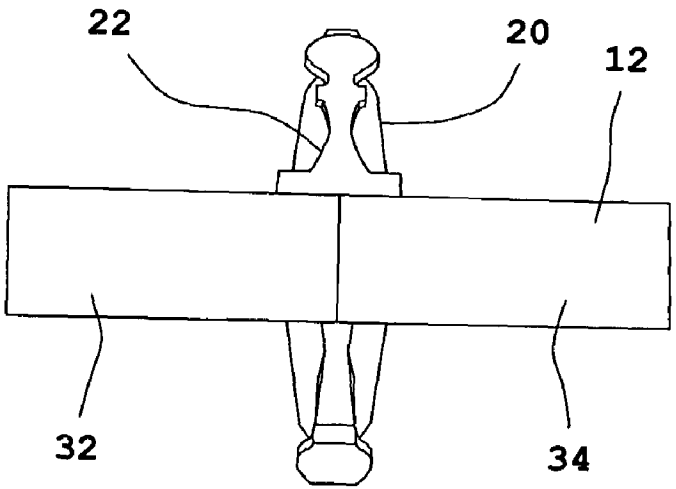
FIG. 3 is a back view of the substrate, nonconductive element and associated conductive element shown in FIG. 2.
Figure 5:
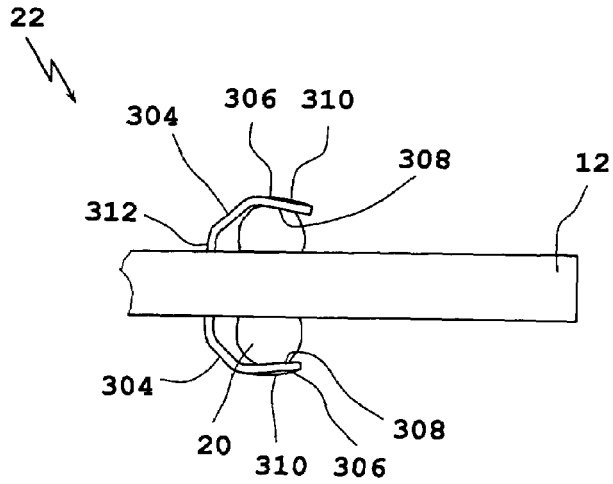
FIG. 5 is a schematic view of the substrate, nonconductive element and associated conductive element shown in FIG. 2, shown with the conductive element formed in a bent position and deflected.

With respect to FIGS. 3 and 4 a nonconductive element 20 and the associated conductive element 22 forming an electrical contact 40 are shown as assembled in the substrate 12, and prior to compression between the opposing boards. FIG. 5 shows the nonconductive element 20 and associated conductive element 22 forming the electrical contact 40 with axial compressive forces applied from above and below, such as when compressed between the opposing boards.

The nonconductive element 20 is formed of a nonconductive elastomeric polymer, such as Siloxanes. In one embodiment, the nonconductive elements 20 and the substrate 12 are molded as an integral structure. Whether molded together with the substrate 12 as an integral structure or assembled with the substrate by insertion within openings 16, the nonconductive elements 20 are captively retained within the substrate 12, with opposite ends of the nonconductive element 20 disposed beyond respective opposite sides of the substrate. The nonconductive elements 20 may be formed via any process known in the art. In the illustrative embodiment, the portion of the nonconductive element 20 extending from the substrate 12 is in the form of a frustum with the largest width of the frustum adjacent the substrate 12. Retention of the respective nonconductive elements 20 within the respective openings 16 is facilitated by the largest width of the frustum. It should be appreciated, however, that any suitable columnar shape may be employed for the nonconductive element 20.

As shown in FIGS. 3 and, 4, first and second portions 21 and 23 are provided at opposite ends, respectively, of the nonconductive element 20. While the surfaces of a first portion 21 and a second portion 23 of the nonconductive element 20 are depicted as being generally planar, the surfaces of the first portion 21 and/or the second portion 23 may be hemispherical, conical or of any other suitable shape for abutting and/or engaging with the conductive elements 22, as described further below. The polymer used and the shape of the nonconductive element 20 may each be selected for varying and controlling the contact force exerted by the interconnect system 10. The durometer characteristics of materials used for the nonconductive element 20 may be selected for accommodating application specific conditions.

The conductive element 22 will now be described with respect to FIGS. 3–9. Each conductive element 22 includes a flat body 302 and first and second arms 304. Each arm 304 has a portion 306 having an inner surface 308 and an outer surface 310. As shown, the portion 306 of each arm 304 may be located at the end of the respective arm 304, with the respective portions 306 disposed at opposite ends of the conductive element 22. An electrical path is provided between the outer surfaces 310 of the respective portions 306 disposed at the opposite ends of the conductive element 22. When the electrical interconnect system 10 is assembled, the end portions are disposed exteriorly of the respective opposite ends 21 and 23 of the nonconductive elastomeric element 20 for forming contact 40. The opposite ends 21, 23 of the nonconductive elastomeric element 20 resiliently press against the respective portions 306 at the opposite ends of the conductive element 22 when a force is applied to the electrical contact 40.

When inserted into a corresponding second opening 18, the body 302 of the conductive element 22 is substantially disposed within the second opening 18. The body 302 may include a retaining structure for retaining the conductive element 22 within the second opening 18, where the retaining structure may be a separate structure added to the body, or may be provided by the body itself. In the example provided, the retaining structure is provided by the body itself, where a width of the body 302 exceeds the width of the second opening 18 for retaining the conductive element 22 within the second opening 18. During assembly of the conductive element 22 with the substrate 12, the conductive element 22 is forcibly inserted into the second opening 18. Due to the compressible property of the substrate 12, a force is exerted on the conductive element 22 which contributes to retaining the conductive element 22 within the second opening 18.

The body 302 may further be provided with a shoulder portion 312 which extends from an upper portion of the body 302 and abuts a top surface of the substrate 12 for stopping further insertion of the conductive element 22 within the second opening 18 and for determining the insertion depth of the conductive element 22 within the second opening 18. The first and second arms 304 extend from the body 302 and are bendable and/or flexible so that the inner surface 308 of the portion 306 of the respective first and second arms 304 abuts the surface of the first portion 21 and second portion 23 of the nonconductive element 20, respectively. The shape of the inner surface 308 of the portions 306 may be formed to conform to the shape of the surface of the first portion 21 and second portion 23 of the nonconductive element 20. The portions 306 may further be provided with a structure for abutting or grabbing the first portion 21 and/or the second portion 23 of the nonconductive element 20 for positioning the conductive element 22 with respect to the nonconductive element 20 with which it is associated.

Figure 7:
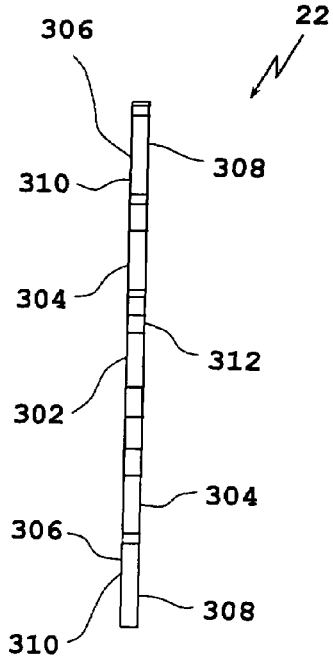
FIG. 7 is a schematic diagram of a side view of the conductive element, shown in an extended position, of the electrical interconnect system in accordance with the first embodiment of the disclosure.
Figure 8:
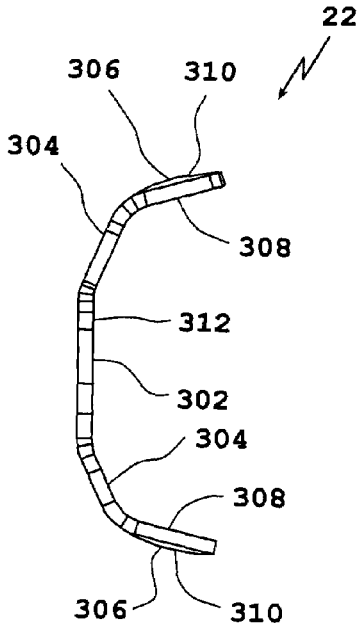
FIG. 8 is a schematic diagram of a front vies of the conductive element, shown formed in a bent position, of the electrical interconnect system in accordance with the first embodiment of the disclosure.
Figure 9:
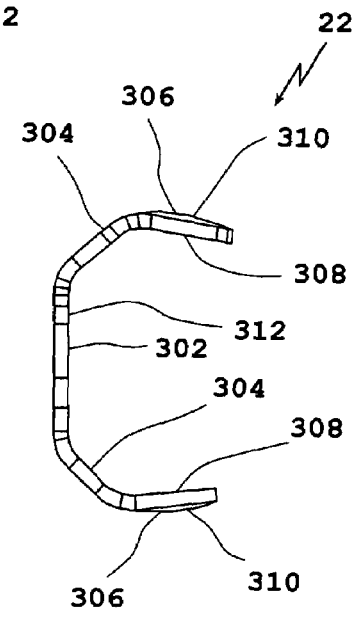
FIG. 9 is a is a schematic diagram of a side view of the conductive element, shown formed in a bent position and deflected, of the electrical interconnect system in accordance with the first embodiment of the disclosure.
Figure 6:
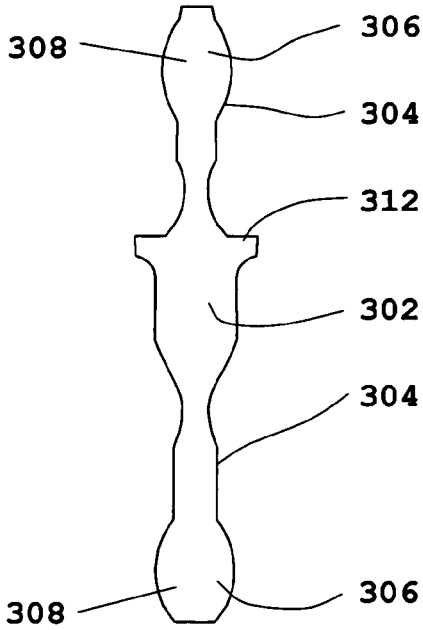
FIG. 6 is a schematic diagram of a front view of a conductive element, shown in an extended position, of an electrical interconnect system in accordance with a first embodiment of the disclosure.

FIGS. 6 and 7 show the conductive element 22 once it has been cut and stamped from metal sheet stock. FIGS. 3, 4 and 8 show the conductive element 22 formed in a bent position for abutting and/or engaging the nonconductive element 20 or for preparing to abut and/or engage the nonconductive element 20. FIGS. 5 and 9 show the conductive element 22 formed in a bent position and deflected, such as due to an axial compressive force, for abutting and/or engaging the nonconductive element 20. As shown in FIGS. 3, 4 and 5, the outer surface 310 of the portions 306 of the arms 304 of the conductive element 22 are exposed as a contact area for making electrical contact with electrical contacts of the opposing boards, and providing an electrical path between an electrical contact of one board of the opposing boards and a corresponding electrical contact of the other opposing board.

The conductive element 22 may be formed entirely of a conductive metal, such as copper, a phosphor bronze alloy, beryllium, gold, nickel, silver, or an alloy of the aforementioned elements or alloy. It is envisioned that other materials may be used to form the conductive element 22, as long as the electrical path is provided between the outer surface 310 of the respective portions 306 of the first and second arms 304, where the electrical path is preferably formed entirely of metal. The shape of the outer surface 310 of the respective portions 306 may be generally planar, hemispherical, conical or of any other suitable shape for abutting and/or engaging respective electrical contacts of the opposing boards. The abutting of a respective outer surface 310 of the respective conductive element 22 with the respective electrical contact of the opposing boards may include surface-to-surface contact depending on the shapes of the respective outer surface 310 and the respective conductive element 22 of the opposing boards. Minimal axial compressive forces may be sufficient to establish reliable electrical connectivity between the conductive elements 22 of the electrical interconnect system 10 and the contacts of the opposing boards, and for establishing electrical connectivity between the corresponding electrical contacts of the opposing boards. Furthermore, establishment of the electrical connectivity is not susceptible to excessive axial compressive forces.

When the substrate 12 and array of electrical contacts 40 are assembled with the opposing boards, axial compressive forces applied from the opposing boards cause a moment associated with each nonconductive element 20 and associated conductive element 22 which may force movement of the contact point on the conductive element 22, hence causing contact wipe in which contacts wipe against the opposing board contact area. Referring again to FIG. 1, the array of openings 14 has a left area 42, a right area 44, a top 48 and a bottom 50. The respective nonconductive elements 20 are oriented relative to the associated conductive elements 22 in accordance with a first orientation on the left area 42, and in accordance with a second orientation on the right area 44. In the first orientation, conductive elements 22 disposed within second openings of row 46 on the left area 42 of the array 40 abut and/or engage the nonconductive elements 20 disposed in the first openings 16 located above row 46. In the second orientation, conductive elements 22 disposed within the second openings of row 46 on the right area 44 of the array 40 abut and/or engage the nonconductive elements 20 disposed in the first openings 16 located below row 46.

The moments created by the axial compressive forces acting on the nonconductive element 20 and conductive element pairs 22 on left area 42 counter the moments created by the axial compressive forces acting on the nonconductive elements 20 and conductive element pairs 22 on right area 44. It is envisioned that other configurations for providing opposing orientations may be used for countering moments which develop, and is not limited to the configuration shown in FIG. 1. For example, opposing orientations may be used for alternating groups of one or more column of pairs of nonconductive element 20 and associated conductive element 22.

Figure 10:
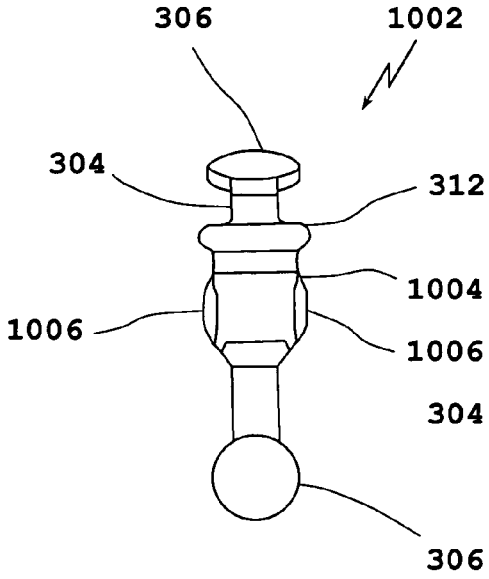
FIG. 10 is a schematic diagram of a back view of a conductive element, shown formed in a bent position, of the electrical interconnect system in accordance with a second embodiment of the disclosure.
Figure 11:
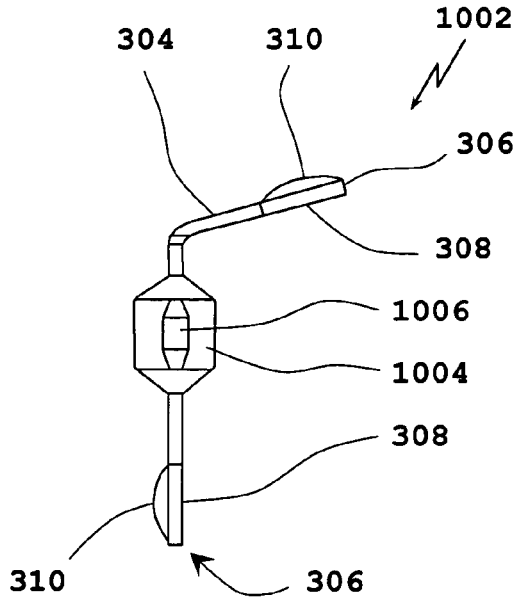
FIG. 11 is a schematic diagram of a side view of the conductive element, shown formed in a partially bent position, of the electrical interconnect system in accordance with the second embodiment of the disclosure.
Figure 12:
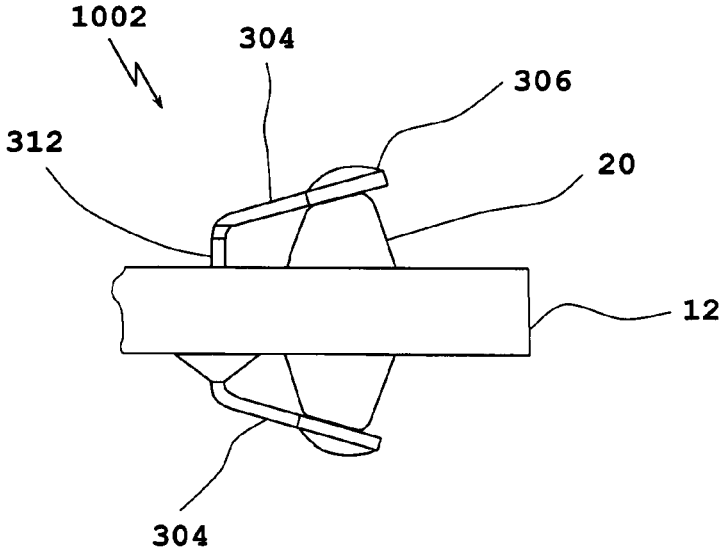
FIG. 12 is a schematic diagram of a side view of the nonconductive element and conductive element disposed in the substrate, with the conductive element shown formed in a bent position, of the electrical interconnect system in accordance with the second embodiment of the disclosure.

FIGS. 10–12 depict a conductive element 1002 which is similar to conductive element 22 in function and in structure, however conductive element 1002 is formed from wire stock, and its body 1004, which corresponds to body 302 of conductive element 22, is rounded, e.g., barrel shaped. The width of the body 1004 may exceed the width of the opening within which it is retained for contributing to retaining the body 1004 in the second opening 18. The body 1004 may further be provided with a retention structure 1006 which extends laterally from the body in opposing directions for contributing to retaining the body 1004 in the second opening 18. The retention structure 1006 is preferably rigid, and may be formed of metal. The body 1004 may further include shoulder 312. Similar to conductive element 22, conductive element 1002 includes arms 304 having portions 306, where the portions 306 have inner and outer surfaces, 308 and 310, respectively. The arms 304 may bend at a joint, or may be flexible for bending where desired.

Figure 13:
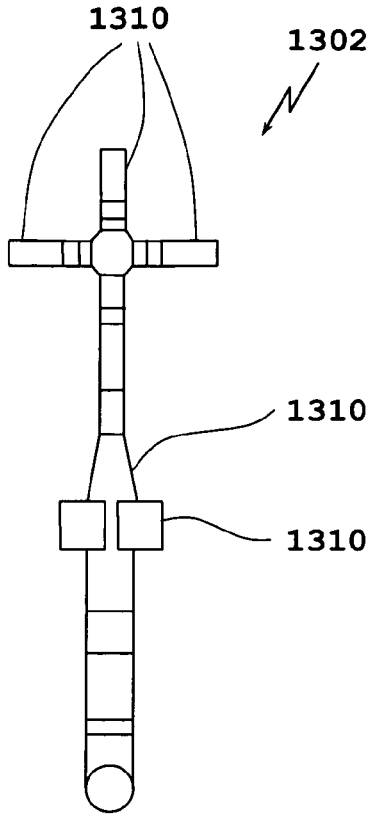
FIG. 13 is a schematic diagram of a front view of a conductive element, shown in an extended position, of the electrical interconnect system in accordance with a third embodiment of the disclosure.
Figure 14:
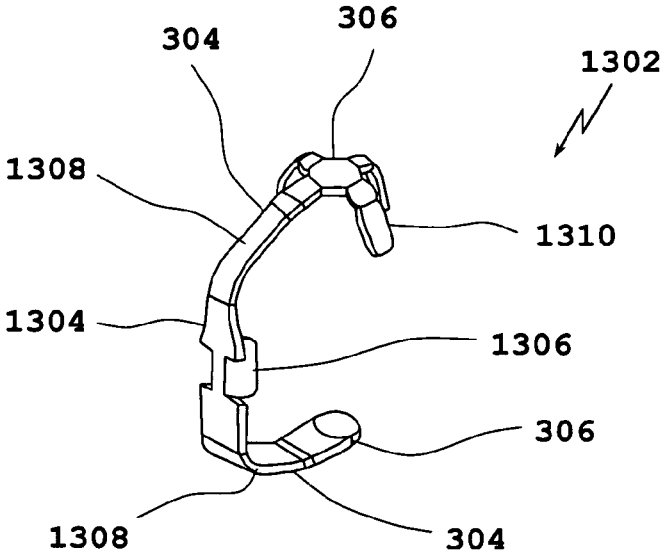
FIG. 14 is a schematic diagram of a side perspective view of the conductive element, shown in a bent position, of the electrical interconnect system in accordance with the third embodiment of the disclosure.
Figure 15:
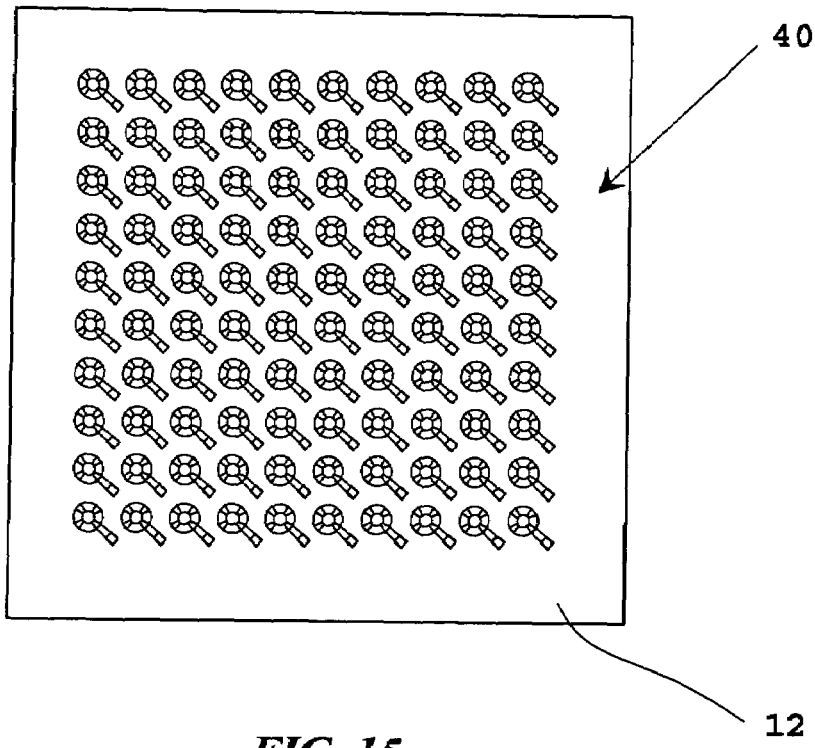
FIG. 15 is a top view of the electrical interconnect system in accordance with the third embodiment of the disclosure.
Figure 16:
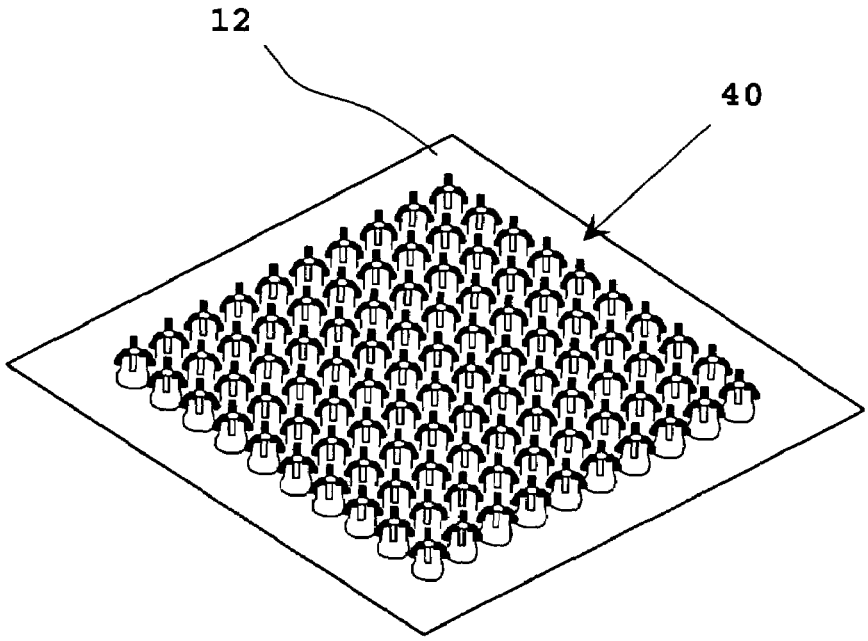
FIG. 16 is a side perspective view of the electrical interconnect system in accordance with the third embodiment of the disclosure.

FIGS. 13 and 14 depict a conductive element 1302 which is similar to conductive element 22 in function and in structure, however the body 1304 of conductive element 1302, which corresponds to body 302 of conductive element 22, is smaller in width than the second opening 18 within which it is disposed. The body 1304 includes a retention structure 1306 which when expanded has a width larger than the width of the second opening 18 within which the body 1304 is disposed, but may be compressed to a width equal to or smaller than the width of the second opening 18. Furthermore, the retention structure 1306 is biased for returning to the larger width when not compressed. The retention structure 1306 may include, for example, a biasing device, such as spring, or be formed of a material which has memory for returning to a shape having the larger width when not compressed. FIGS. 15 and 16 depict the array 40 in which the conductive elements 1302 are employed.

The portions 306 of the arms 304 are provided with one or more joints 1308. Additionally, the portion 306 of at least one of the arms 304 is provided with an engaging structure 1310, such as two or more prongs, and depicted as three prongs in FIGS. 13 and 14. The engaging structure 1310 aids in positioning the conductive element 22 with respect to the nonconductive element 20 with which it is associated, such as for guiding the conductive element 22 to abut the nonconductive element 20 with which it is associated as the axial compressive force is being exerted; preventing the conductive element 1302 from abutting a different nonconductive element 20; and for maintaining the conductive element 22 in the desired position with respect to the nonconductive element 20 with which it is associated before and/or after the axial compressive force is exerted. The engaging structure 1310 may abut and/or engage the nonconductive element 20.

It is envisioned that retention of the nonconductive elements 20 within the respective first openings 16 may be achieved by providing one or more retaining structures on the nonconductive elements 20 and/or in the respective first openings 16, where retaining structures provided with both of the nonconductive elements 20 and the respective first openings 16 may be complementary. Similarly, retention of the conductive elements 22 within the second openings 18 may be achieved by providing a retaining structure on each of the conductive elements 22 and in the second openings 18, where retaining structures provided with both of the conductive elements 22 and the second openings 18 may be complementary.

The electrical interconnect system 10, in accordance with the present disclosure, provides the advantages of providing an entirely conductive electrical path through the conductive element 22, where the electrical path is made of a highly conductive material, such as metal. Furthermore, the electrical interconnect system 10 provides for, due to the elastomeric properties of the nonconductive elements 20, exertion of a constant mechanical force by the nonconductive elements 20 on the contacts of the opposing boards when an axial compressive force is exerted by opposing boards on the electrical interconnect system 10. The constant mechanical force enhances the electrical connection between the conductive elements 22 and the contacts of the opposing boards. With a minimal axial compressive force reliable conductivity is established between corresponding contacts of the opposing boards.

The described embodiments of the present invention are intended to be illustrative rather than restrictive, and are not intended to represent every embodiment of the present invention. Various modifications and variations can be made without departing from the spirit or scope of the invention as set forth in the following claims both literally and in equivalents recognized in law.

The invention claimed is:

1. An electrical interconnect system comprising:

a substrate; and an array of electrical contacts held in the substrate, each of the electrical contacts including a nonconductive elastomeric element having opposite ends that are disposed beyond respective opposite sides of the substrate, and an associated conductive element including a unitary body having opposite ends that are disposed exteriorly of the respective opposite ends of the nonconductive elastomeric element, wherein the opposite ends of the nonconductive elastomeric element resiliently press against the respective opposite ends of the conductive element when a force is applied to the electrical contact.

2. The electrical interconnect system according to claim 1, wherein the force is an axial compressive force.

3. The electrical interconnect system according to claim 1, wherein an electrical path is defined from an exterior surface of one end of the opposite ends of the conductive element to an exterior surface of the other end of the opposite ends of the conductive element.

4. The electrical interconnect system according to claim 1, wherein the substrate includes an array of openings for holding the respective electrical contacts of the array of electrical contacts.

5. The electrical interconnect system according to claim 4, wherein the array of openings includes a first plurality of openings holding respective said nonconductive elements and a second plurality of openings holding respective said conductive elements.

6. The electrical interconnect system according to claim 1, wherein a first portion of the array of electrical contacts are held in the substrate with the nonconductive element and conductive element of respective said electrical contacts of the first portion oriented with respect to one another in a first direction, and a second portion of the array of electrical contacts are held in the substrate with the nonconductive element and conductive element of respective said electrical contacts of the second portion oriented with respect to one another in a second direction.

7. The electrical interconnect system in accordance with claim 1, wherein the conductive element includes a retaining structure for retaining the conductive element, the retaining structure being positioned within the substrate.

8. The electrical interconnect system in accordance with claim 7, wherein the retaining structure includes a biasing device.

9. The electrical interconnect system in accordance with claim 1, wherein the respective electrical contacts of the array of electrical contacts are press fit within respective openings in the substrate for retaining the respective electrical contacts within the substrate.

10. An electrical interconnect system comprising:

a substrate; and an array of electrical contacts held in the substrate, each electrical contact comprising:

a columnar elastomeric nonconductive element having opposite ends that are disposed beyond respective opposite sides of the substrate; and an associated conductive element comprising:

a unitary body having opposite ends, said ends having respective exterior surfaces; and an electrical path defined from the exterior surface of one end of the opposite ends of the body to the exterior surface of the other end of the opposite ends of the body;

wherein the opposite ends of the nonconductive elastomeric element resiliently press against the respective opposite ends of the conductive element when a force is applied to the electrical contact.

11. The electrical interconnect system in accordance with claim 10, wherein the force is an axial compressive force.

12. The electrical interconnect system in accordance with claim 10, wherein the conductive element includes a retaining structure for retaining the conductive element, the retaining structure being positioned within the substrate.

13. The electrical interconnect system in accordance with claim 12, wherein the retaining structure includes a biasing device.

14. The electrical interconnect system in accordance with claim 12, wherein the retaining structure is formed of a material which has memory.

15. The electrical interconnect system a in accordance with claim 10, wherein the conductive element is formed from sheet stock.

16. The electrical interconnect system in accordance with claim 10, wherein the conductive element is formed from wire stock.

17. The electrical interconnect system in accordance with claim 10, wherein at least one of the respective opposite ends of the conductive element comprises an engaging structure configured for positioning the conductive element with respect to the nonconductive element with which it is associated.

18. The electrical interconnect system in accordance with claim 10, wherein the substrate includes an array of openings within which the respective electrical contacts are retained, and the unitary body of the conductive element includes a shoulder portion for preventing further insertion of the conductive element into the opening within which it is held.

19. A method for forming an electrical interconnect system comprising the steps of:

providing a substrate; and providing an array of electrical contacts held in the substrate, providing for each of the electrical contacts:

a nonconductive elastomeric element having opposite ends that are disposed beyond respective opposite sides of the substrate, and an associated unitary conductive element having first and second opposite ends that are respectively disposed exteriorly of the opposite ends of the nonconductive elastomeric element; and applying a force to the electrical contact, wherein when the force is applied the opposite ends of the nonconductive elastomeric element resiliently press against the respective opposite ends of the unitary conductive element.

20. The method in accordance with claim 19, further comprising the step of providing an electrical path from an exterior surface of one end of the opposite ends of the conductive contact to an exterior surface of the other end of the opposite ends of the conductive contact.

* * * * *